United States Patent [19]

Mackworth-Young

[11] 4,319,515

[45] Mar. 16, 1982

[54] TUNING AID FOR TUNING MUSICAL INSTRUMENTS

[76] Inventor: Robin Mackworth-Young, Garden House, Windsor Castle, Berkshire SL4 1NG, England

[21] Appl. No.: 36,260

[22] Filed: May 4, 1979

[30] Foreign Application Priority Data

May 10, 1978 [GB] United Kingdom ..... 18737/78

[51] Int. Cl.[3] ..... G10G 7/02

[52] U.S. Cl. ..... 84/454; 84/455; 324/99 R; 324/149

[58] Field of Search ..... 84/454, 455, 477 R; 324/79 R, 79 D, 149

[56] References Cited

U.S. PATENT DOCUMENTS

| | | | |
|---|---|---|---|
| 3,968,719 | 7/1976 | Sanderson | 84/454 |
| 4,023,462 | 5/1977 | Denov | 84/454 |
| 4,163,408 | 8/1979 | Capano | 84/454 |

FOREIGN PATENT DOCUMENTS

| | | | |
|---|---|---|---|
| 1213794 | 11/1970 | United Kingdom | 84/454 |

*Primary Examiner*—L. T. Hix
*Assistant Examiner*—S. D. Schreyer
*Attorney, Agent, or Firm*—Blanchard, Flynn, Thiel, Boutell & Tanis

[57] ABSTRACT

A tuning aid for tuning musical instruments, particularly keyboard instruments, includes a sensor unit (12) which has an elongate capacitative sensor probe which is capable of extending across one octave of the instrument, and an octave switch (22) and a tone switch (20) on which are manually set the nominal octave and note of the string being measured. Amplifiers (16,24) including an AGC amplifier and controlled band-pass filters (18,26) are responsive to the octave and tone switches to select the measured tone. A divider (32) responsive to the octave switch divides the measured frequency by a power of two. A divider (38) is connected to the output of a crystal oscillator (36) to divide by a factor dependent upon the tone switch setting. The outputs of the two dividers are compared in a discriminator (34) which compares the two frequencies. A meter (50) displays the sense and magnitude of the discriminator output so as to display in terms of cents the amount by which the frequencies differ. A sample and hold circuit (46) actuated by the AGC circuit (28) causes the display to be held for a period of ten seconds, while operation is inhibited for the first 150 milliseconds of the note sounded.

14 Claims, 3 Drawing Figures

TUNING AID FOR TUNING MUSICAL INSTRUMENTS

BACKGROUND OF THE INVENTION

This invention is concerned with tuning aids for tuning musical instruments, in particular keyboard instruments.

The invention provides in one aspect an improved tuning aid which uses particularly simple circuitry to provide an accurate measurement of the frequency of any selected note.

The invention also provides in another aspect an enhanced display of the measurement, which display is more readily ascertainable by the musician.

Also the invention provides in a further aspect an improved sensor for a tuning aid for use in tuning stringed instruments which is relatively insensitive to noise, and furthermore can be made in different shapes to give greater flexibility in use.

The invention in its various aspects is defined in the appended claims, to which reference should now be made.

BRIEF DESCRIPTION OF THE DRAWINGS

The invention will be described in detail, by way of example, with reference to the drawings, in which.

DETAILED DESCRIPTION OF THE PREFERRED EMBODIMENT

Figure 1:
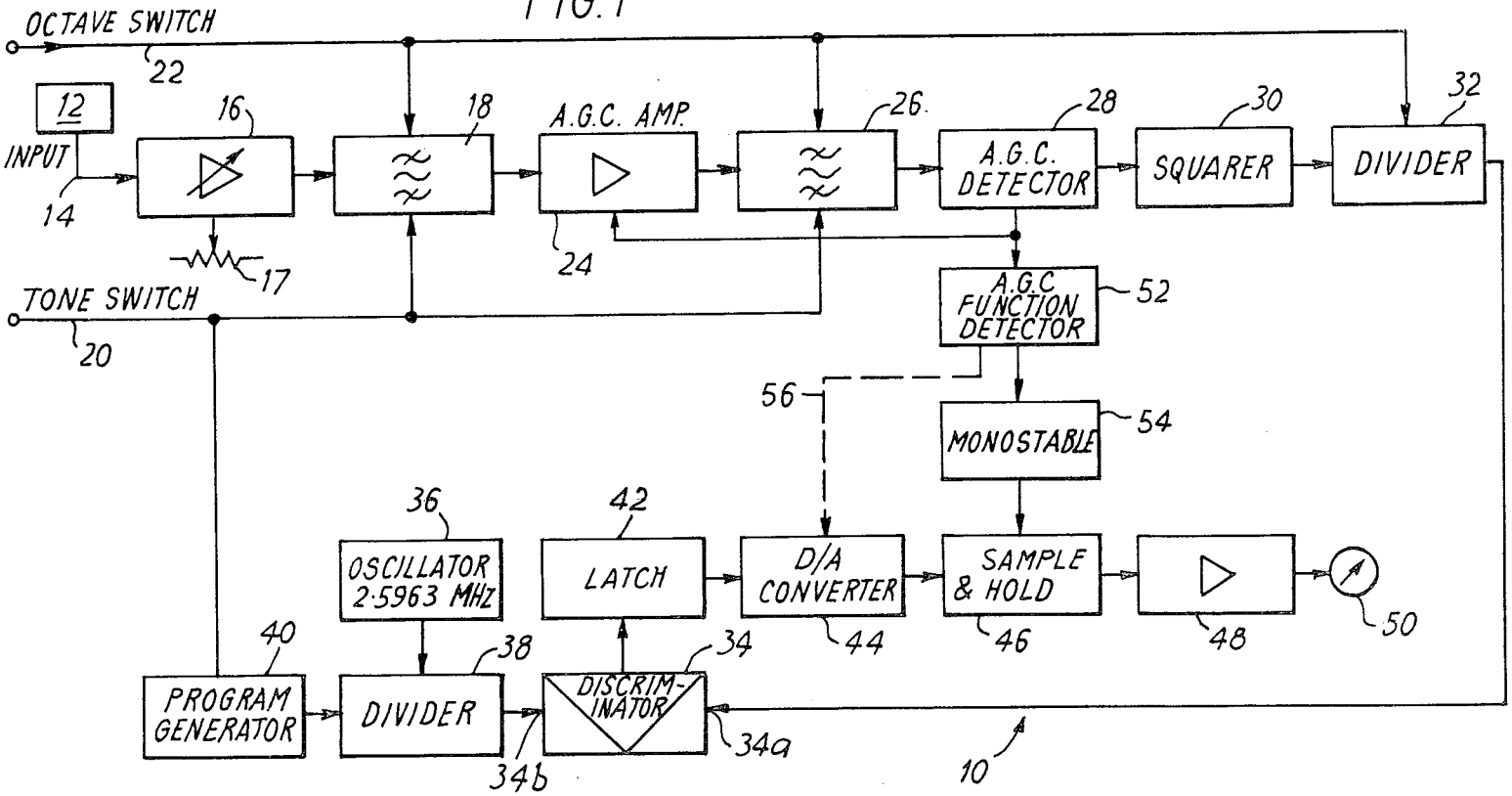
FIG. 1 is a block diagram of the circuitry of the main part of a tuning aid embodying the invention.

Referring to the drawing, a tuning aid designed for tuning stringed instruments, particularly keyboard instruments, has a main unit 10 shown in FIG. 1 and also a sensing head 12, illustrated diagrammatically. The main unit 10 has an input 14 which, in use of the device, is connected to the output of the pick-up head. A high input impedance amplifier 16 receives the signal from the input and is preferably manually adjustable by means of a volume control 17. An active band-pass filter 18 is connected to the output of amplifier 16. The band-pass filter includes an RC circuit in which the resistance used is selected from twelve possible values by means of a tone switch, and the capacitance used is selected from six possible values by means of an octave switch. In FIG. 1 the switches are diagrammatically represented by control lines 20 and 22 respectively. The centre frequency of the band-pass filter is varied by means of the tone switch in the ratio required for an equi-tempered scale, as given in the following table.

TABLE

| | |
|---|---|
| A | 1.000 |
| A#, $B^b$ | 1.059 |
| B | 1.122 |
| C | 1.189 |
| C#, $D^b$ | 1.260 |
| D | 1.335 |
| D#, $E^b$ | 1.414 |
| E | 1.498 |
| F | 1.587 |
| F#, $G^b$ | 1.682 |
| G | 1.782 |
| G#, $A^b$ | 1.888 |

TABLE-continued

| | |
|---|---|
| A | 2.000 |

The centre frequency of the band-pass filter is varied by means of the octave switch in the ratio of powers of two. Thus the combination of the two switches can select any required tone or pitch over a range of six octaves.

An AGC amplifier 24 is connected to the output of the band-pass filter 18 and a second band-pass filter 26 of identical construction to the filter 18 is connected to the output of the amplifier 24. More band-pass filters can be used if found desirable; the band-pass filters together present a sufficiently high Q factor to discriminate effectively against the main harmonics emitted by the string being tuned. An AGC detector 28 is connected to the output of filter 26 and supplies the control signal for the AGC amplifier 24.

A squaring circuit 30 converts the output of the AGC detector 28 into square wave pulses at the frequency of the input signal and these pulses are divided by a power of two in a programmable divider 32. The selected power of two is determined by the setting of the octave switch, and for example for middle A of 440 Hz (Hertz), and the octave above it, the divisor is 16. In this way the output of the divider will nominally range from 27.5 Hz (for A natural) to 51.9 Hz (for G #), regardless of the actual octave.

The output of the divider is applied to one input **34*a* of a frequency discriminator 34. The other input 34*b* of the frequency discriminator 34 receives the output of a quartz crystal controlled oscillator 36 after division in a second programmable divider 38. The crystal oscillator provides an output of 2.5963 MHz and this is divided by a fixed factor to give a frequency of 137 KHz and then multiplied by the appropriate factor given in the Table above in dependence upon the output of a program generator 40 controlled by the setting of the tone switch. In fact this division and multiplication are combined into a single division operation. Thus the output of the divider 38** will range between 137 and 259 KHz in dependence on the tone selected from A to G #.

The frequency discriminator 34 thus receives two signals at its inputs **34*a* and 34*b*, of which the signal at input 34*a* represents the actual frequency of the string being tuned, adjusted to bring it (nominally) within the range 27.5 to 51.9 Hz, while the input 34*b*** receives an extremely accurate frequency which lies within the range 137 to 259 KHz in dependence on the required tone. If the string is in tune, the two inputs differ in frequency by a factor of exactly 5,000.

The frequency discriminator operates by counting the number of pulses received at its input **34*b* between the leading edges of two successive pulses received at its input 34*a*. This count is applied to a latch circuit 42 where it is held until replaced by a subsequent count. The frequency discriminator includes counters arranged such that if the number of pulses received at its input 34*b* between two pulses at its input 34*a*** is exactly 5000, then the output of the discriminator will be 500, i.e. 4500 is subtracted from the count. Any difference in the number of pulses counted and 5000 is reflected as an equal difference in the output from 500. Thus the output differs from 500 by the number of five-thousandths by which the string is out of tune. One five-thousandth (or 0.02%) represents one three-hundredth of a semitone, i.e. about 0.3 cents, (one cent being one hundredth of a semitone).

Thus as the measured frequency changes by ±50 cents, the discriminator output varies between 354 and 646. The output of the latch circuit 42 is, as shown, applied to a digital-to-analogue converter 44 and thence to a sample-and-hold circuit 46. The output of the sample-and-hold circuit is applied through a buffer amplifier 48 to a moving coil meter 50. Because the normal value of the discriminator output is 500 rather than zero, a standard meter can be used rather than one with a centre zero.

The sample-and-hold circuit 46 is controlled as follows. The AGC signal from the AGC detector 28 is, in addition to controlling the AGC amplifier 24, also applied to an AGC function detector circuit 52. This circuit detects whether the AGC voltage is above or below a defined level, and whether it is increasing or decreasing. This information then drives a monostable circuit 54, as described in more detail below, which in turn controls the sample-and-hold circuit 46.

The operation of the circuit of FIG. 1 will now be described with reference to the tuning of a keyboard instrument.

To use the device the musician first selects the string to be tuned and places a sensor adjacent the string. The sensor is preferably as described below. The sensor forms part of a pick-up unit which includes a preamplifier and the output of which is connected by a screened lead to the input 14. The musician sets the octave and tone switches to the octave and tone which is appropriate for the particular string. Then he strikes the note.

The frequencies produced are amplified by the amplifiers 16 and 24, and from them, the band-pass filters 18 and 26 select the fundamental frequency of the particular tone. The AGC loop ensures that the signal is essentially independent of the sound intensity so that the squarer 30 can produce accurate square wave pulses. The pulse frequency produced can then be accurately measured against a reference frequency.

The frequency discriminator 34 compares the reference frequency at its input **34*b* with the incoming frequency, after division in divider 32, and as noted above the number of pulses produced will depend upon the accuracy of the note. The error in tuning is converted into an analogue signal which is held in the sample-and-hold circuit 46 and displayed on the meter 50**. The meter is calibrated in cents over a range of +50 to −50 cents, thus the pointer indicates both the sense and magnitude of the pitch error.

Some notes are typically detectable for only about 400 to 600 milliseconds (ms). This is sufficient time to make the measurement, but it is not sufficient for the musician to read it accurately from the meter. The sample-and-hold circuit 46 thus holds the meter reading for a period of about 10 seconds. This is achieved by the monostable circuit 54 which is set by the AGC function detector when it senses a large AGC signal, indicating the presence of a signal to be measured. In fact it is desirable for there to be a short delay of typically 150 ms between the AGC function detector detecting the presence of an input and setting the monostable. This delay means that the first 150 ms of the signal are not used for measurement, so that large interfering signals which occur briefly at the instant when the string is struck do not affect the measurement.

When the input signal is removed, the AGC control voltage is low, and this causes an artificial number of pulses to reach the converter 44 (as indicated schematically by the dashed line 56) so that the meter 50 is set to mid-position where it remains until the next input is received.

Clearly the meter 50 could be replaced by a digital display device in which case the converter 44 would be omitted and the sample-and-hold circuit 46 would be replaced by a latching circuit, which could conveniently be combined with the latching circuit 42. A scale adjustment would be needed to allow for the fact that each output unit from the discriminator represents 0.3 cents rather than one cent, and it would be desirable to provide an output which varied positive and negative about zero.

By repeating the operation for different strings, with different settings of the octave and tone switches, the whole instrument may be tuned. When tuning different octaves, it may in fact be desirable to tune the octave containing middle A accurately at 440 Hz, and then to tune the other octaves so that each note is accurately tuned to the first harmonic of the note in the octave below. The procedure for this involves the following steps: (i) tune middle A, (ii) set the octave switch to one octave higher, i.e. the first harmonic of middle A, and note the meter reading, and (iii) tune the next higher A to the same meter reading.

Figure 2:
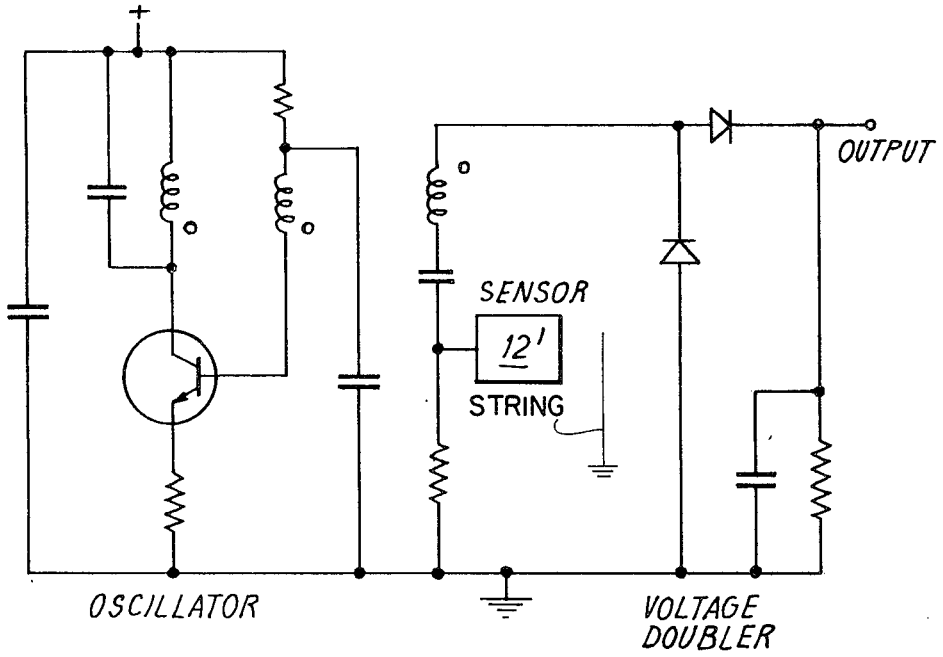
FIG. 2 is a circuit diagram of a suitable pick-up head for use with the circuitry of FIG. 1.

The pick-up head 12 comprises a simple oscillator, supplied either by a separate battery or directly from the main circuit. The output of the oscillator is conveniently taken from one end of an oscillator coil via a voltage doubling circuit, while the other end of the coil is conneted to a sensor head. The circuit diagram of one example of pick-up head is shown in FIG. 2 and will be clear from an inspection thereof.

Figure 3:
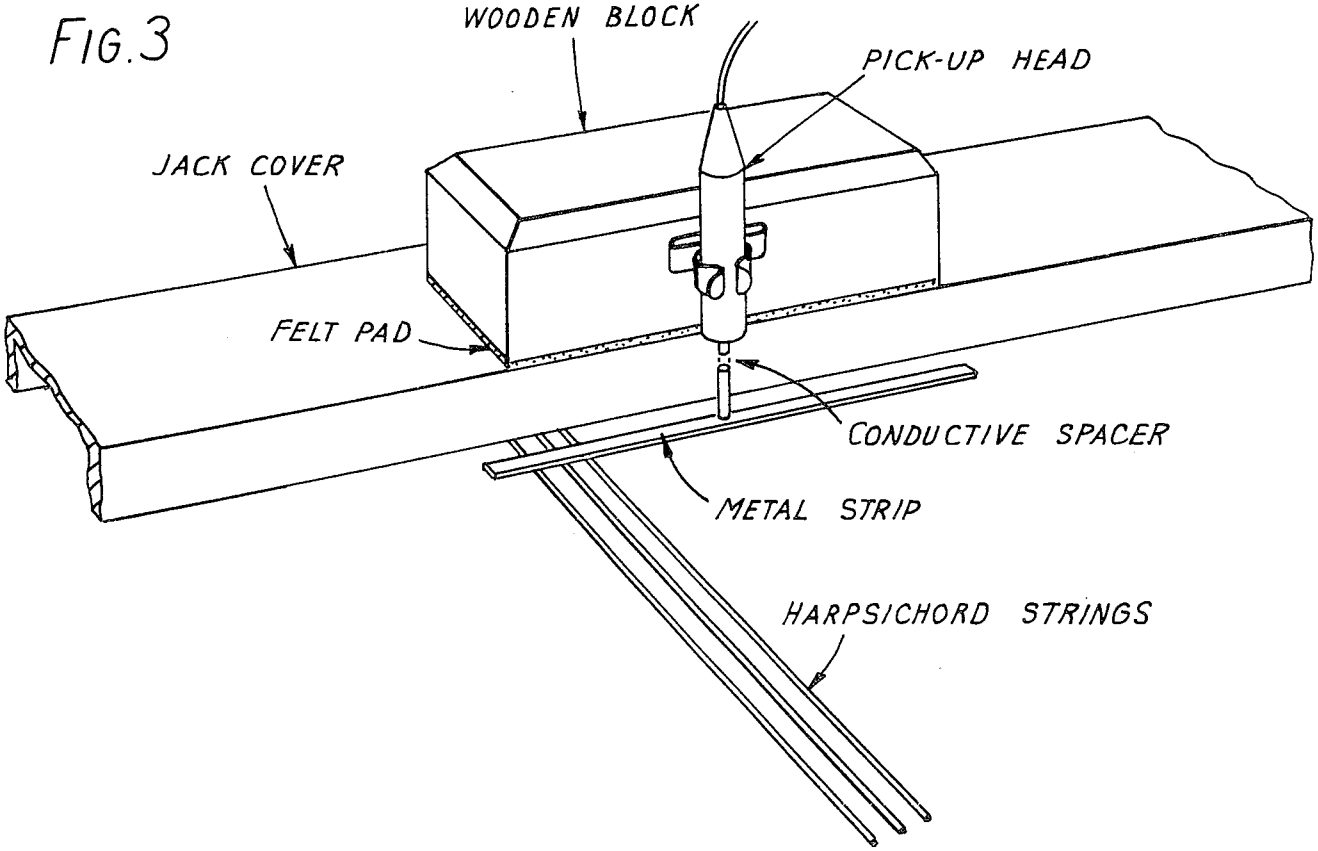
FIG. 3 illustrates an example of the pick-up head sensor.

The sensor iteself is capacitative, and can be formed simply of a strip of metal extending transversely across the strings. Typically the strip is long enough to span the strings of one octave. The strip may be used edge-on or face-on to the strings. An example of the sensor is illustrated in FIG. 3.

Such a sensor is of particular use in tuning harpsichords. For tuning the lower ranks of strings of a harpsichord, the sensor can take the form of a comb-shaped member, possibly with curved or bent teeth which can pass between strings of the upper rank so as to be in close proximity to the lower rank.

Alternatively, the capacitative sensor can be replaced by a microphone, and this will be necessary for tuning other instruments, e.g. wind instruments.

The combination of the automatic gain control circuits and the sample and hold circuit permits the apparatus to be used in the presence of considerable background noise, which in practice is a great advantage. This noise immunity is further enhanced when the capacitative sensor is used.

What is claimed is:

1. A tuning aid for tuning musical instruments, comprising:

an input for connection to an audio sensor;

manually operable setting controls for setting the nominal octave and note of the signal being measured;

amplifying and band-pass filtering means coupled to the input and responsive to the setting controls;

first dividing means responsive to the setting controls for dividing the frequency of the detected signal by a factor dependent upon the octave determined by the setting controls;

a high stability oscillator;

a second dividing means for dividing the output of the oscillator by a factor dependent upon the note determined by the setting control;

comparison means for counting the number of pulses from the second dividing means for a period of time set by the output of the first dividing means to thereby compare the frequencies of the first and second dividing means; and display means for displaying the output of the comparison means.

2. A tuning aid as claimed in claim 1, including means for subtracting a predetermined number from the said counted number of pulses.

3. A tuning aid for tuning musical instruments, comprising:

an input for connection to an audio sensor;

manually operable setting controls for setting the nominal octave and note of the signal being measured;

amplifying and band-pass filtering means coupled to the input and responsive to the setting controls;

first dividing means responsive to the setting controls for dividing the frequency of the detected signal by a factor dependent upon the octave determined by the setting controls;

a high stability oscillator;

second dividing means for dividing the output of the oscillator by a factor dependent upon the note determined by the setting controls;

comparison means for comparing the frequencies of the first and second dividing means; and display means for displaying the output of the comparison means;

means for causing the display means to hold the display for a predetermined minimum period even if the input signal ceases before the end of the period; and delay means for delaying the operation of the tuning aid for a predetermined period after an input signal is received at the input terminal.

4. A tuning aid as claimed in claim 3, including an automatic gain control (AGC) circuit coupled between the input and the comparison means, and wherein the holding means is actuated in response to the operation of the AGC circuit.

5. A tuning aid as claimed in claim 3, including an automatic gain control (AGC) circuit coupled between the input and the comparison means, and wherein the delay means is actuated in response to the operation of the AGC circuit.

6. A pitch measurement device, comprising:

input means for connection to an audio sensor to supply an input signal to be measured;

individual manually-operable controls for respectively setting the nominal octave and note within an octave of the signal to be measured;

first and second band-pass filtering means coupled in series to the input means and each responsive to the setting controls for passing signals of desired pitch to be measured;

an automatic gain control (AGC) circuit including an AGC amplifier connected in series between said first and second filtering means and further including an AGC detector monitoring the output of said second filtering means for supplying an AGC voltage to said AGC amplifier and thereby making essentially independent of sound intensity the signal output of said second filtering means;

squarer means receiving said signals of desired pitch to be measured from said AGC detector and producing a square waveform signal of the same frequency;

first dividing means responsive to the octave setting controls for dividing the frequency of the square waveform signal by a factor dependent upon the octave selected by the octave setting controls, and thereby producing frequency signals which are (1) all located within a first single preselected octave and (2) each located in said first single octave in correspondence to the location of said input signal in a higher octave;

a high stability crystal oscillator;

second dividing means for dividing the output of the oscillator by a factor dependent upon the note determined by the note setting controls and thereby producing reference frequency signals which are (1) all located in a second preselected octave and (2) each located in said second preselected octave in correspondence to the location of the desired pitch in its own octave, said second preselected octave being of frequency much higher than that of said first preselected octave;

frequency discriminator means for comparing the frequencies of the output signals of said first and second dividing means, said frequency discriminator means being adapted to count the number of pulses from the second dividing means for a period of time equal to the duration of a preselected part of the output waveform of the first dividing means;

latch means for subtracting a predetermined number from the said counted number of pulses, said subtracted predetermined number being a large fraction of the counted number corresponding to an input signal frequency identical to said desired pitch;

display means for displaying the output of said latch means, wherein the display means displays the sense and magnitude of the output of the latch means so as to display in terms of cents the amount by which the input signal differs from the desired pitch;

holding means actuated in response to the operation of the AGC circuit for causing the display means to hold the display for a predetermined minimum period even if the input signal ceases before the end of the period;

delay means actuated in response to the operation of the AGC circuit for delaying the operation of the pitch measurement device for a predetermined period after an input signal is received at said input.

7. A tuning aid for tuning stringed musical instruments comprising the measuring unit of claim 6 and a sensor unit having an elongate capacitive sensor probe which is capable of extending across a plurality of strings.

8. The apparatus of claim 6 including a digital/analog converter for producing a voltage magnitude proportional to the number of pulses produced by said latch;

said holding means being a sample and hold circuit for applying the voltage output of said d/a converter to a meter, for holding a given meter reading for a period of time long enough to enable convenient reading by the operator of the device.

9. The device of claim 6 including an AGC function detector driven by the AGC signal from said AGC detector for detecting a large AGC signal sufficient to indicate the presence of an input signal to be measured;

a monostable multi-vibrator set by said AGC function detector when it senses a large AGC signal indicating the presence of an input signal to be measured, the output of said monostable multi-vibrator controlling reading out of the output of said latch means, said AGC function detector and monostable multi-vibrator cooperating to provide said holding means and delay means.

10. The device of claim 6 in which the period of counting by said discriminator means is the period of one pulse cycle of said first dividing means, the period of said first dividing means being about 5,000 times the period of said second dividing means, such that said frequency discriminator produces an output signal of about 5,000 pulses when the sensed frequency is equal to the desired pitch, said latch means subtracting about 4,500 pulses from the pulse train output of said discriminator means so as to magnify by approximately a factor of 10 a discrepancy between said sensed frequency and desired pitch, the number of pulses produced by said latch means being increased and decreased in dependence on the magnitude and polarity of frequency error between the sensed frequency and desired pitch.

11. A pitch measurement device, comprising:

an input for connection to an audio sensor to supply an input signal;

manually operable setting controls for setting the nominal octave and note of the signal being measured;

amplifying and band-pass filtering means coupled to the input and responsive to the setting controls;

first dividing means responsive to the octave setting controls for dividing the frequency of the detected signal by a factor dependent upon the octave determined by the setting controls;

a high stability oscillator;

second dividing means for dividing the output of the oscillator by a factor dependent upon the note determined by the note setting controls and thereby producing reference frequency signals which are (1) all located in a second preselected octave and (2) each located in said second preselected octave in correspondence to the location of the desired pitch in its own octave, said second preselected octave being of frequency much higher than that of said nominal octave;

comparison means for comparing the frequencies of the outputs of the first and second dividing means, said comparison means being adapted to count the number of pulses from the second dividing means for a period of time equal to the duration of a preselected part of the output waveform of the first dividing means;

display means for displaying the output of the comparison means, wherein the display means displays the sense and magnitude of the output of the comparison means so as to display in terms of cents the amount by which the input signal differs from the desired pitch;

the display means being provided with means which causes the display means to hold the display for a predetermined minimum period even if the input signal ceases before the end of the period; and delay means for delaying the operation of the tuning aid for a predetermined period after an input signal is received at said input.

12. The device of claim 11, including a sensor unit having an elongate capacitive sensor probe which is capable of extending across a plurality of strings of a stringed musical instrument.

13. In a tuning aid, for tuning stringed musical instruments of the type having several side-by-side metallic strings, comprising a measuring unit for receiving an electrical input signal, comparing its frequency with a reference, and displaying the result of the comparison;

the improvement comprising a sensor unit having an elongate capacitative sensor probe which is capable of extending across a plurality of said metallic strings in capacitive relation therewith.

14. The device of claim 13, in which said capacitive sensor probe comprises an elongate metal strip long enough to extend transversely across said plurality of metallic strings, means for mounting said metal strip in close spaced relation transversely across said plurality of metallic strings in capacitively coupled relation therewith, and oscillator circuit means including said probe as a capacitive tuning element therein for providing said signal to said measuring unit.

* * * * *